United States Patent [19]

Schreiner

[11] Patent Number: 4,545,340

[45] Date of Patent: Oct. 8, 1985

[54] IGNITION DISTRIBUTOR FOR AN INTERNAL COMBUSTION ENGINE

[75] Inventor: Hermann Schreiner, Hemmingen, Fed. Rep. of Germany

[73] Assignee: Dr. Ing. h.c.F. Porsche Aktiengesellschaft, Stuttgart, Fed. Rep. of Germany

[21] Appl. No.: 623,325

[22] Filed: Jun. 22, 1984

[30] Foreign Application Priority Data

Jun. 23, 1983 [DE] Fed. Rep. of Germany ..... 3322545

[51] Int. Cl.[4] ..... F02P 1/00

[52] U.S. Cl. ..... 123/146.5 A; 200/306; 200/19 DR

[58] Field of Search ..... 123/146.5 A; 200/19 DR, 200/19 DC, 306

[56] References Cited

U.S. PATENT DOCUMENTS

| | | | |
|---|---|---|---|
| 1,935,465 | 11/1933 | Allendorff | 200/306 |
| 2,067,391 | 1/1937 | Good | 200/19 DR |
| 2,150,859 | 3/1939 | Gibson | 200/306 |
| 2,251,387 | 8/1941 | Arthur | 200/19 DR |
| 2,945,430 | 7/1960 | Slick | 200/306 |
| 3,336,457 | 8/1967 | Julian | 200/19 DC |
| 3,875,920 | 4/1975 | Williams | 123/146.5 A |
| 4,348,993 | 9/1982 | Ueno | 123/146.5 A |

*Primary Examiner*—Ronald B. Cox

*Attorney, Agent, or Firm*—Craig & Burns

[57] ABSTRACT

A rotor with vanes is secured on the distributor shaft of the ignition distributor, by means of which ozone produced by arc formation during the interruption of the high-voltage current, is discharged through openings of the distributor housing into the atmosphere.

5 Claims, 1 Drawing Figure

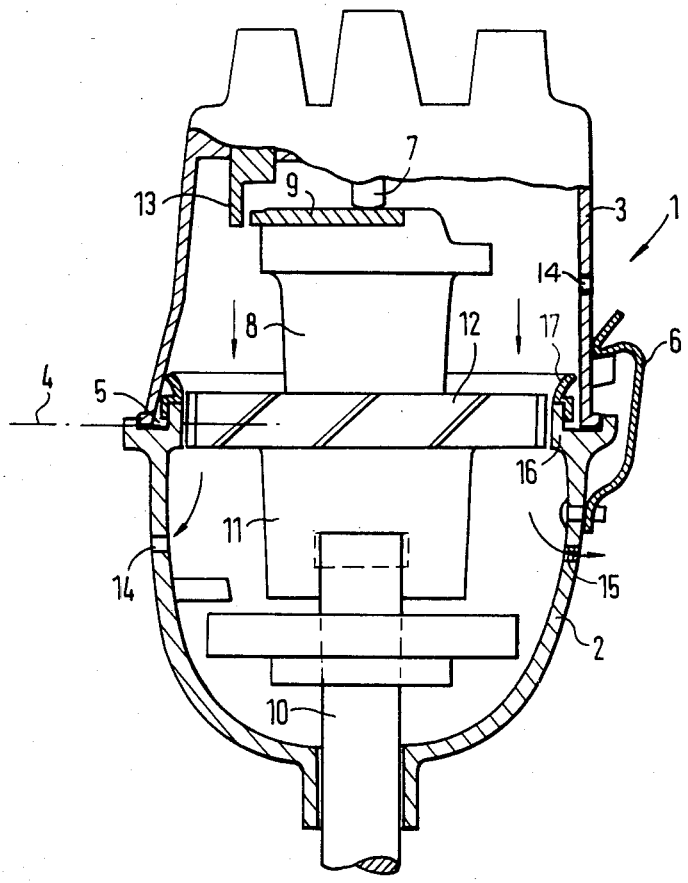
7
9
13
3
1
14
8
12
17
6
4
5
16
11
14
15
2
10

IGNITION DISTRIBUTOR FOR AN INTERNAL COMBUSTION ENGINE

The present invention relates to an ignition distributor for an internal combustion engine whose housing is composed of a distributor housing and of a distributor cap detachably secured thereon, whereby a current-interrupting device is accommodated in the distributor cap which consists of an electrode rotating in unison with the distributor shaft and of several fixed circumferential electrodes cooperating therewith.

With such types of ignition distributors, arcs occur during the interruption of the high-voltage current, which lead to the formation of ozone. The ozone has a strong oxidation action and causes corrosion at the contacts and other metal parts of the ignition distributor during longer interaction. The aging of the lubricant at the bearing places of the ignition distributor is also accelerated in an undesirable manner by the ozone interaction. One therefore aims at removing the forming ozone as rapidly as possible out of the housing of the ignition distributor.

It is known in connection therewith from the German Offenlegungsschrift No. 20 09 125 to provide the ignition distributor with venting holes in the distributor cap or in the distributor housing. However, it is disadvantageous that dust, water and fuel vapor can enter at the same time into the housing of the ignition distributor together with the fresh air entering through the holes. For that reason, it has been proposed heretofore to decompose the ozone by a catalyst. However, also this measure is unsatisfactory since it requires too frequent and costly servicing operations.

It is therefore the object of the present invention to provide a cost-favorable arrangement for the removal of the ozone out of the ignition distributor.

The underlying problems are solved according to the present invention in that a blade wheel or rotor is secured on the distributor shaft which discharges the gases out of the distributor cap through openings of the housing into the atmosphere.

The blade wheel or rotor rotating together with the distributor shaft produces an air flow, in which the ozone is removed and discharged immediately during its creation and is conveyed through openings in the distributor housing or in the distributor cap into the atmosphere. Dust and liquid particles are prevented by the impulse of this gas flow to enter through the openings into the housing of the ignition distributor. In order to prevent their passage also during standstill of the distributor shaft, throttling elements are inserted into the openings which are pervious for the gas flow but not pervious for solid and liquid particles. Such throttling elements are particularly appropriate for vent openings which may be provided in the housing on the suction side of the blade wheel or rotor in order to suck into the housing fresh air as carrier gas for the ozone through these vent openings.

In a preferred embodiment according to the present invention, the blade wheel or rotor is constructed as axial pump wheel, is combined with the entrainment part secured at the distributor shaft into a unitary structural part and is arranged in the separating plane between distributor cap and distributor housing. In order to increase the pumping efficiency, the blade wheel or rotor is surrounded with narrow radial clearance by an annular extension of the distributor housing, whereby a nozzle is provided on this extension at the inflow side of the blade wheel or rotor.

These and other objects, features and advantages of the present invention will become more apparent from the following description when taken in connection with the accompanying drawing which shows, for purposes of illustration only, one embodiment in accordance with the present invention, and wherein:

The single FIGURE is an elevational view, partly in cross section, through an ignition distributor in accordance with the present invention.

Referring now to the single FIGURE of the drawing, an ignition distributor is surrounded by a housing generally designated by reference numeral 1 which consists of a distributor housing 2 and of a distributor cap 3, having an opening 14 therein. Within a separating plane 4, the distributor cap 3 is located in an annular groove 5 of the distributor housing 2 and is clamped together with the latter by three straps 6. A center electrode 7 is secured concentrically in the upper part of the distributor cap 3 which contacts an electrode 9 securely mounted on the distributor shaft 8. The distributor shaft 8 is driven by a drive shaft 10 by way of an entrainment member 11, on which is mounted a blade wheel or rotor 12. The electrode 9 rotating in unison with the distributor shaft 8 applies the high voltage produced by an ignition coil at the rhythm of the ignition sequence to the spark plugs of the cylinders by way of the circumferential electrodes 13 fixed in the distributor cap 3. The ozone which is produced by the arc formation during the interuption of the high-voltage current is conveyed out of the distributor cap 3 into the atmosphere by means of the blade wheel or rotor 12 through openings 14 of the distributor housing 2. Throttling elements 15 are inserted into the openings 14 in order to prevent the entry of dirt and liquid into the distributor housing during standstill of the distributor shaft 8. The blade wheel or rotor 12 is arranged with slight radial clearance in an annular extension 16 of the distributor housing 2, on which is provided a nozzle 17 on the inflow side of the blade wheel or rotor 12 for the improvement of the pumping action.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An ignition distributor for internal combustion engines, comprising housing means including a distributor housing and a distributor cap detachably secured on said distributor housing, current-interrupting means provided in said distributor cap including an electrode rotating in unison with a distributor shaft and several fixed circumferential electrodes cooperating with said rotating electrode, a blade wheel means secured on said distributor shaft which is operable to remove the gases out of the distributor cap into the atmosphere through openings in the housing means, said blade wheel means being arranged between the rotating electrode and an entrainment member of the distributor shaft operatively connected with a drive shaft near the separating plane between the distributor housing and cap and forming together with the entrainment member a unitary structural part, said distributor housing including an annular extension which surrounds the blade wheel means with slight radial clearance and extending substantially over the width thereof, and wherein a nozzle means is provided at the annular extension, said nozzle means becoming narrower in the direction toward the inflow side of the blade wheel means.

2. An ignition distributor for internal combustion engines, comprising housing means including a distributor housing and a distributor cap detachably secured on said distributor housing, current-interrupting means provided in said distributor cap including an electrode rotating in unison with a distributor shaft and several fixed circumferential electrodes cooperating with said rotating electrode, a blade wheel means secured on said distributor shaft which is operable to remove the gases out of the distributor cap into the atmosphere through openings in the housing means, said distributor housing including an annular extension which surrounds the blade wheel means with slight radial clearance and extending substantially over the width thereof, and wherein a nozzle means is provided at the annular extension, said nozzle means becoming narrower in the direction toward the inflow side of the blade wheel means.

3. An ignition distributor according to claim 1, further comprising throttle means inserted into the openings provided in the distributor housing, which are operable to prevent the penetration of liquid into the distributor housing.

4. An ignition distributor according to claim 3, wherein said blade wheel means is constructed as axial pump wheel.

5. An ignition distributor according to claim 2, further comprising throttle means inserted into the openings provided in the distributor housing, which are operable to prevent the penetration of liquid into the distributor housing.

* * * * *